US005669174A

United States Patent [19]

Teetzel

[11] Patent Number: 5,669,174

[45] Date of Patent: Sep. 23, 1997

[54] LASER RANGE FINDING APPARATUS

[76] Inventor: James W. Teetzel, 151 Lafayette Rd., Portsmouth, N.H. 03801

[21] Appl. No.: 488,649

[22] Filed: Jun. 8, 1995

Related U.S. Application Data

[63] Continuation-in-part of Ser. No. 303,860, Sep. 9, 1994, Pat. No. 5,584,137, which is a continuation-in-part of Ser. No. 200,204, Feb. 23, 1994, Pat. No. 5,481,819, which is a continuation-in-part of Ser. No. 89,889, Jul. 12, 1993, Pat. No. 5,425,299, which is a continuation-in-part of Ser. No. 73,766, Jun. 8, 1993, Pat. No. 5,355,608.

[51] Int. Cl.[6] ..... F41G 1/36

[52] U.S. Cl. ..... 42/103; 362/114; 356/5.01; 89/41.06; 89/41.17

[58] Field of Search ..... 42/103; 362/110, 362/114; 356/5.01; 89/41.17, 41.06

[56] References Cited

U.S. PATENT DOCUMENTS 3,897,150 7/1975 Bridges et al. ..... 356/5.04
3,927,480 12/1975 Robertson ..... 356/5.01
4,695,161 9/1987 Reed ..... 356/254

*Primary Examiner*—Stephen M. Johnson
*Attorney, Agent, or Firm*—William B. Ritchie

[57] ABSTRACT

A laser range finder that is modular so that it can mounted on different weapon platforms. A pulsed infrared laser beam is reflected off the target. The timed return signal is then used to measure the distance. Another laser, either a visible laser or another infrared laser of differing frequency, is used to place a spot on the intended target. Notch pass optical filters serve to eliminate ambient light interference from the second laser. The range finder using projectile information stored in the unit processes the calculated distance to raise or lower the finder on the weapon. A plurality of weapon platforms and projectile is selected by pressing the desired rubberized keypad. The range finder can be used with a laser detonated projectile that can be detonated when the projectile is over the target. The projectile is fitted with a detector that is sensitive to the frequency of a wide angle laser beam that is attached to the weapon. Using the range obtained by the range finder, the wide angle laser beam is fired when the projectile is in proper position relative to the target.

5 Claims, 15 Drawing Sheets

LASER RANGE FINDING APPARATUS

This application is a continuation-in-part of U.S. patent application Ser. No. 08/303,860, filed Sep. 9, 1994, now U.S. Pat. No. 5,584,137 which is a continuation-in-part of U.S. patent application Ser. No. 08/200,204, filed Jul. 23, 1994, now U.S. Pat. No. 5,481,819, which is a continuation-in-part of U.S. patent application Ser. No. 08/089,889, filed Jul. 12, 1993, now U.S. Pat. No. 5,425,299, which is a continuation-in-part of U.S. patent application Ser. No. 08/073,766, filed Jun. 8, 1993, now issued as U.S. Pat. No. 5,355,608.

BACKGROUND OF THE INVENTION

1. Field of the Invention

The invention relates to the use of lasers on small firearms to permit a combined sighting and range finder capability.

2. Description of the Related Art

It is well known that even a skilled marksman with a handgun has been unable to hit a target as close as 7 meters when attempting to draw the weapon and fire at speed. In target shooting, the shooter must obtain the proper stance by carefully positioning the feet and the "free" hand to find the most stable condition, producing no muscular strain that will adversely effect the accuracy of the shot. Most importantly, the shooter must be able to obtain an identical position each time the weapon is fired to achieve the greatest accuracy. As the whole upper torso moves during each breath, breath control plays a vital role in the process. Since there can be no body movement at the time the trigger is fired, obviously the act of breathing must be stopped during the time the weapon is aimed and fired.

Sight picture and aim are critical if the shooter is to fire the most accurate shot or series of shots. When a mechanical pistol sight is properly aligned, the top of the front sight should be level with the top of the rear sight, with an equal amount of light on either side of the front sight. Using this sight picture requires that the shooter focus his shooting eye so that the sights are in focus and the target is out of focus. Added to the difficulty is the trigger which must be released using direct, even pressure to keep the barrel of the gun pointing at the target. These skills require tremendous practice, with each shot fired needing the utmost concentration if the shooter is to obtain maximum accuracy.

It is clear that the recommended methods of achieving maximum shooting accuracy useful for target shooting, must be severely modified when a handgun is used in a law enforcement situation. While the degree of accuracy necessary for target shooting and the distances and substantial lower, accuracy is still vital. Law enforcement officials are instructed to fire only as a last resort, cognizant of the fact that their intended target will most likely be killed. Shooting to wound occurs only in the movies. Law enforcement officers typically use higher caliber handguns, mostly 9 mm, which are designed to immobilize with a single shot if that shot strikes a vital area. Given the inherent inaccuracies in the shooting process, itself, exacerbated by the stress and fear of the police officer in what may be a life threatening situation for him/her, the exact location of the bullet where millimeters can mean the difference between death and survival cannot be known a priori by the even the most skilled marksman.

Mechanical sights have limited value in many situations where an officer must quickly draw his gun, perhaps while moving, and fire at a close target without sufficient time to properly obtain a sight picture. Under these circumstances, instinctive aiming, that is, not using the sights but rather "sensing where the gun barrel is pointing using the positioning of the hand holding the gun, is the preferred method. While this method, akin to the typical television cowboy shootouts, can be reasonably effective at short distances, obviously large errors in aiming are easily introduced, especially when the officer must frequently fire his/her weapon from a different hand position that has been used for practice. For example, bullet proof shields are used to protect the officer from being fired upon such as in a riot situation. In those circumstances, the officer must reach around his/her shield or other barricade and instinctively aim and fire his/her gun with the handgun in a very different orientation than would be experienced if fired from a standing, drawn from a holster position. Small changes in barrel orientation due to the sight radius of the typical law enforcement handgun can produce substantial errors relative to the target. Accurate instinctive shooting is not considered practical beyond 20 feet for the average shooter.

The same problems face a soldier in a combat situation. While a rifle is inherently more accurate than a handgun, the stress of combat, the need to fire rapidly but accurately in order to survive is sufficient to introduce substantial errors into the sighting process. These problems are further exacerbated by the fact that most military personnel do not have sufficient practice time with their weapon to develop a high proficiency, particularly in combat simulated situations.

An additional problem encountered in the military situation is the need for a sighting system that can be easily moved from one weapon to another. As warfare increases in sophistication, the need for more versatile armaments increases correspondingly. Ideally, an operator should be able to quickly and confidently move the sighting system from one weapon to another without needing any field adjustments.

Laser technology has been previously introduced as a solution to the problem of accurately and rapidly sighting a handgun on an intended target. The typical laser sight is mounted on the top on the handgun or on the bottom. The laser sight when properly aligned, places a red light dot on the target where the bullet will strike if the gun is fired. Using this type of sight, enables the law enforcement officer to rapidly, instinctively, properly position the weapon and be certain of his/her intended target. Using a laser sight enables accurate shots to be fired at distances of more than 50 feet, sufficient for most combat law enforcement situations requiring the use of handguns.

Laser sights have proved their worth for sighting weapons having substantially fiat trajectories over extended distances such as the M-16 or for powerful handguns having a relatively fiat trajectory over a short, effective firing distance such as 9 mm. However, the usefulness for laser sights is substantially diminished when used with weapons that launch a projectile having a large and highly variable trajectory over the effective firing range of weapon, for example, the mortar. The mortar is, in essence, a muzzle loading cannon that fire shells at low velocities, comparatively short ranges, and at a substantial angular elevation due to the large trajectory of the projectile. The mortar is typically "sighted in" by "guess-timating" the distance to the target, then adjusting the angular elevation after each fired round impacts by "guess-timating" the distance from the target, until the weapon is finally adjusted so that the fired shell will hit the target. A similar situation is present when attempting to fire a grenade launcher. This procedure is wasteful of ammunition, time consuming, and provides the enemy with sufficient time to respond or retreat. It is well known that the error rate of 20% is considered the norm when firing such weapons.

Laser range finding units have been proposed to provide an accurate means for measuring distance from one location to another. One proposed solution is U.S. Pat. No. 3,464,770, issued to Schmidt on Sep. 2, 1969, discloses a combined sighting mechanism and laser range finder. In this invention, a laser sends a beam to the target which must be reflected back to a receiver through an elaborate mirror/lens arrangement. The distance to the device is measured by measuring the time interval between emission and reception. Such a device is not practical for installation on a small arm field weapon due to the extraordinary cost of manufacturing and the delicate nature of necessary optics and electronics.

Another invention representative of this genre is U.S. Pat. No. 4,690,550, issued to Kuhne on Sep. 1, 1987, which discloses a laser range finder that has a common telescope for transmitting and receiving the laser signal. Again, the distance to the target is determined by measuring the time interval between emission and reception.

While these devices as well as the numerous others that exist using that principle will accurately and rapidly permit the determination of the distance to a target, the prior art does not disclose a laser range finding apparatus that is suitable for use with a grenade launcher attached to a rifle or other small arms such as the mortar.

SUMMARY OF THE INVENTION

It is an object of the invention to provide a modular laser range finding apparatus that is sufficiently small so that it can be mounted on a rifle.

It is another object of the invention to provide a modular laser range finding apparatus that can be retro-fitted to standard military rifles such as an M-16.

It is still another object of the invention to provide a modular laser range finding apparatus that can be easily moved from one weapon to another.

It is still another object of the invention to provide a modular laser range finding apparatus that can be used with a SMAW-D.

It is still another object of the invention to provide a modular laser range finding apparatus that can be used with a standard mortar.

It is another object of the invention to provide a modular laser range finding apparatus that can utilize either a visible laser or an infrared laser.

It is another object of the invention to provide a modular laser range finding apparatus that will automatically adjust the proper elevation of the weapon once the laser beam from the apparatus is sighted on the target.

It is still another object of the invention to provide a modular laser range finding apparatus that can be easily adjusted.

Another object of the invention is to provide a modular laser range finding apparatus that can be used with the laser sighting and flashlight apparatus disclosed by the inventor.

Still another object of the invention is to provide a modular laser range finding apparatus that can be used with a projectile which has a detonation mechanism that is laser beam activated wherein the projectile can be detonated at a predetermined height above the target after the modular laser range finding apparatus has ensured that the proper trajectory to the target has been obtained.

It is another object of the invention to provide a modular laser range finding apparatus that can be inexpensively produced using primarily commercially available parts.

It is still another object of the invention to provide a modular laser range finding apparatus that can be controlled using an easily operated keypad.

Finally, it is another object of the invention to provide a modular laser range finding apparatus that can be powered by commercially available batteries, providing at least several hours of service time before needing to be changed.

The invention is a laser range sighting apparatus for determining the range to a selected target. Pulsed laser ranging means is provided for sending a timed laser signal to the target with said signal being reflected from the target. Laser pointing means is provided for selectively pointing a laser spot at the target with said laser pointing means and said pulsed laser ranging means being in the same plane. Selection means is provided for filtering out the reflections emanating from the target as a result of the laser spot emitted by said laser pointing means. An output signal corresponding solely to the reflections received from said pulsed laser ranging means is provided. Processing means is provided for processing the output signal received from said selection means to provide a distance output signal that corresponds to the measured time of said timed pulsed laser signal to reach the target and return to said apparatus. Said distance output signal corresponds to the range of the selected target.

DETAILED DESCRIPTION OF THE INVENTION

Figure 1:
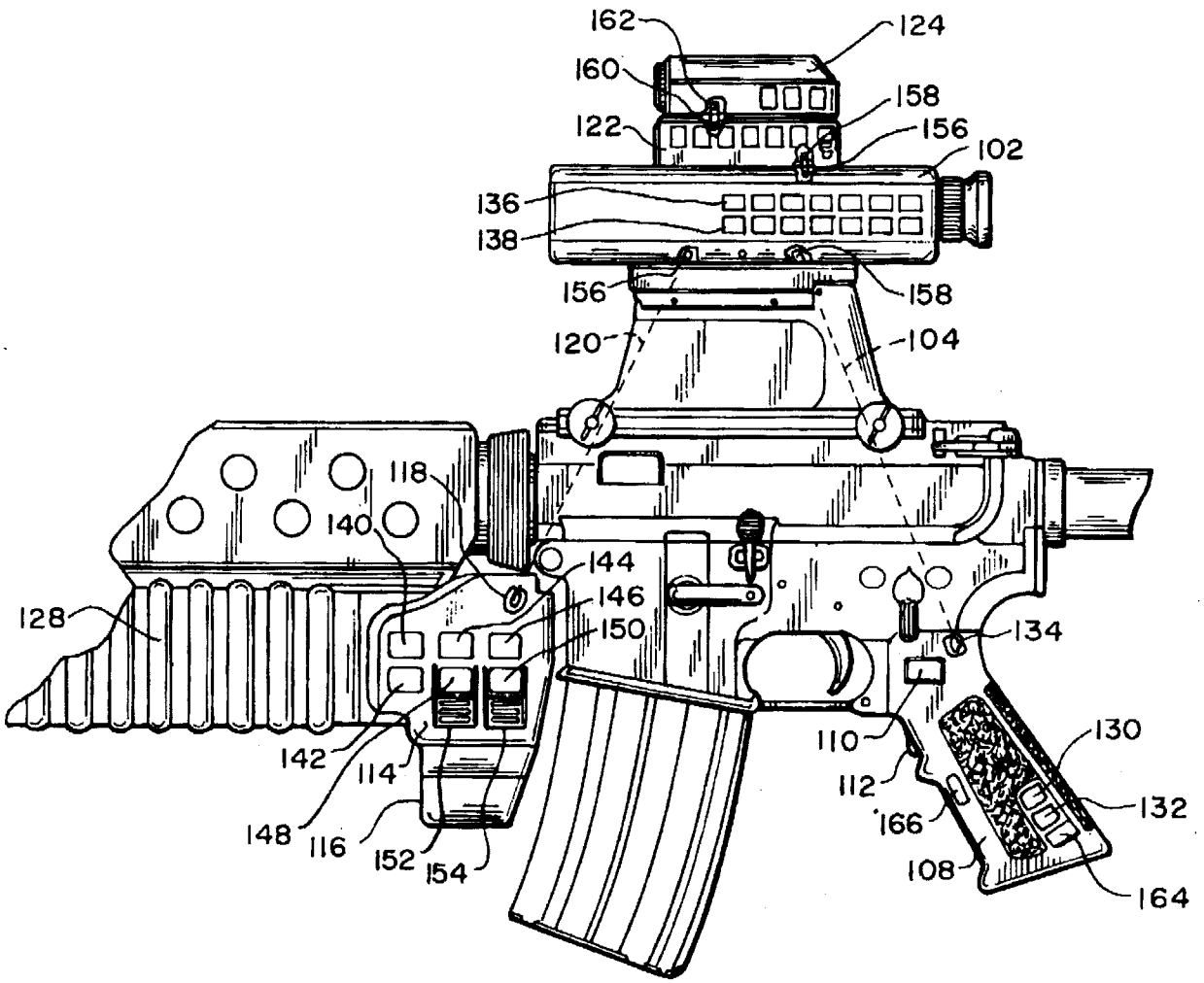
FIG. 1 is a side view of modular laser range finding apparatus mounted on a typical rifle.

The invention is a modular laser range finding system adaptable to the offensive M16, SMAW-D and other small arms. As shown in FIG. 1, invention 102 is modular and can be used with laser sight module 122 and flashlight module 124 previously disclosed in U.S. patent application Ser. No. 08/303,860, filed Sep. 9, 1994. As shown, the modules are mounted on an M-16 type weapon 126 equipped with a 203 grenade launcher 128 modified with an electronic fire control box 114.

The selection of button 132 which indicates "M-16" on the modified handlegrip 108 causes the infrared transmitter 134 to activate the selected laser pointer of laser sight module 122 when the forward activation keypad 110 is likewise depressed.

Arrow up keypad 136 and arrow down keypad 138 on range finder 102 cause range finder 102 to elevate and descend in 50 meter increments to facilitate targeting for the M-16. For use with other weapons, elevation is accomplished automatically.

The selection of button 130 labeled "203" causes infrared transmitter 134 to activate range finder 102 when the forward activation keypad 110 is depressed.

The selection of button 142 labeled "SMART DART" in conjunction with button 130 causes range finder 102 microprocessor 410 (shown in FIG. 4) to relay range target information via infrared communication diodes 156, 118 to grenade launcher electronic fire control box 114. Box 114 contains a detonation timer (not shown) that activates wide angle infrared laser 116. The infrared signal transmitted from the wide angle infrared laser 116 is received by infrared detector 604 on laser detonated projectile 602(shown in FIG. 6). Upon receiving the appropriate infrared signal, laser detonated projectile 602 then detonates. Laser detonated projectile 602 or normal 203 munitions can only be fired when the mechanical trigger 112 is depressed after the proper ordnance keypad 140 or 142 is selected and the "ready" keypad 150 is depressed.

Communication from microprocessor 410 to laser sight module 122 and flashlight module 124 is facilitated using infrared emitters 156, 160 and detectors 158, 162. This communication along with that taking place along infrared path 104 and 120 allows microprocessor 410 to control all aspects of the system.

Additional rubberized keypads 144, 146, 148, 150 are located on the electronic fire control box 114. The "lock" keypad 146 disables all functions on the grenade launcher. The "pulse" keypad 144 allows selection of different preprogrammed infrared frequencies for transmission to laser detonated projectile 602. The "ready" keypad 150 located below sliding protective panel 154 arms the grenade launcher fire control system. The "fire" keypad 148, also located below a sliding protective panel, panel 152, allows manual firing of grenade launcher 128 if used as a stand alone weapon.

The "set" keypad 166, located in handle grip 108, halts constant range finding once the target is acquired. Once keypad 166 is pressed, the range finder's microprocessor 410 stores the distance to the target selected. This information can then be communicated to laser detonated projectile 602 via the wide angle infrared laser 116 transmitter and laser detonated projectile infrared detector 604 (shown in FIG. 6).

Figure 2:
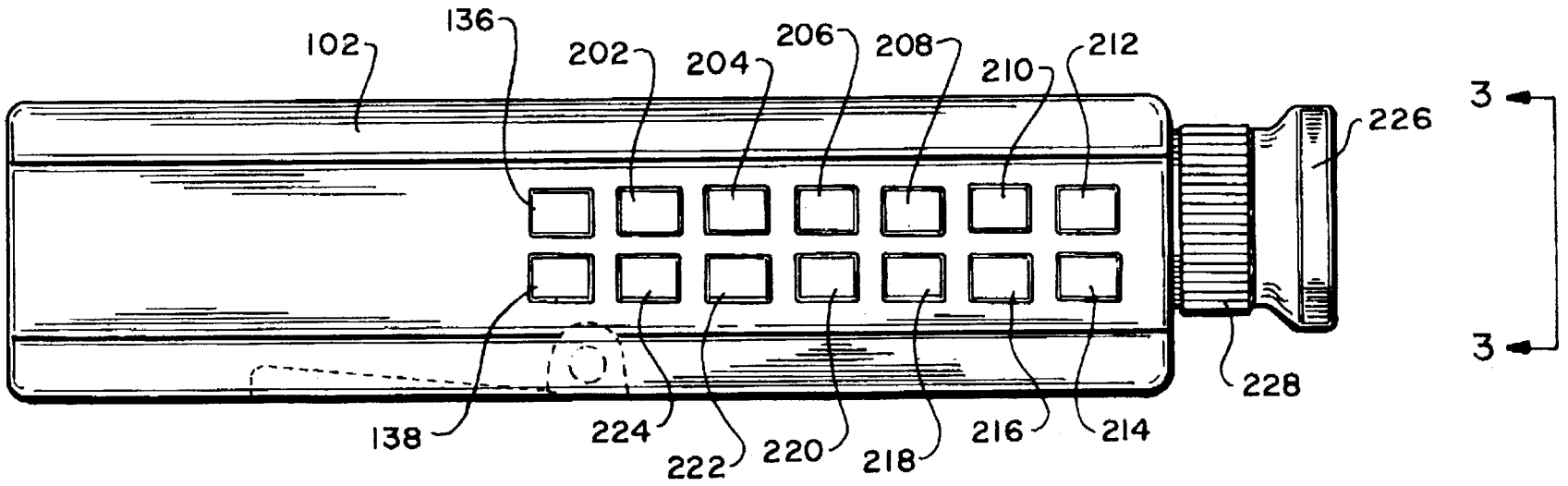
FIG. 2 is a detailed side view of the control panel of the laser range finder.

FIG. 2 is a detailed view of the control panel 103 of laser range finder 102. Control panel 103 is made up of a series of rubberized conductive keypads 202 through 224 that are attached to a circuit board (not shown) inside range finder 102. In order to enable a user to operate the device with a minimum number of decisions, each munition is provided with its own selection button, keypads 202 through 212. Pre-determined trajectory information concerning each selectable ordnance and the various weapons that finder 102 can be installed on is stored in finder 102. The "VIS" keypad 222 selects the visible 635 nm laser pointer (shown in FIG. 5). The "IR" keypad 220 selects the 830 nm infrared laser pointer (shown in FIG. 5). The "YARD/METER" keypad 218 allows the user to select whichever measurement system that he/she is comfortable. The "DISPLAY+" and "DISPLAY−" keypads 216 and 214, respectively, adjust the backlight intensity of the heads-up display when viewed through the finder's eyepiece 226. Inside finder 102, in addition to the laser features, standard telescopic sights are included so that the user can see "dots" provided by finder 102 from substantial distances. Focus adjustment is accomplished through focal ring 228. The "OFF" keypad 224 disables the system.

Figure 3:
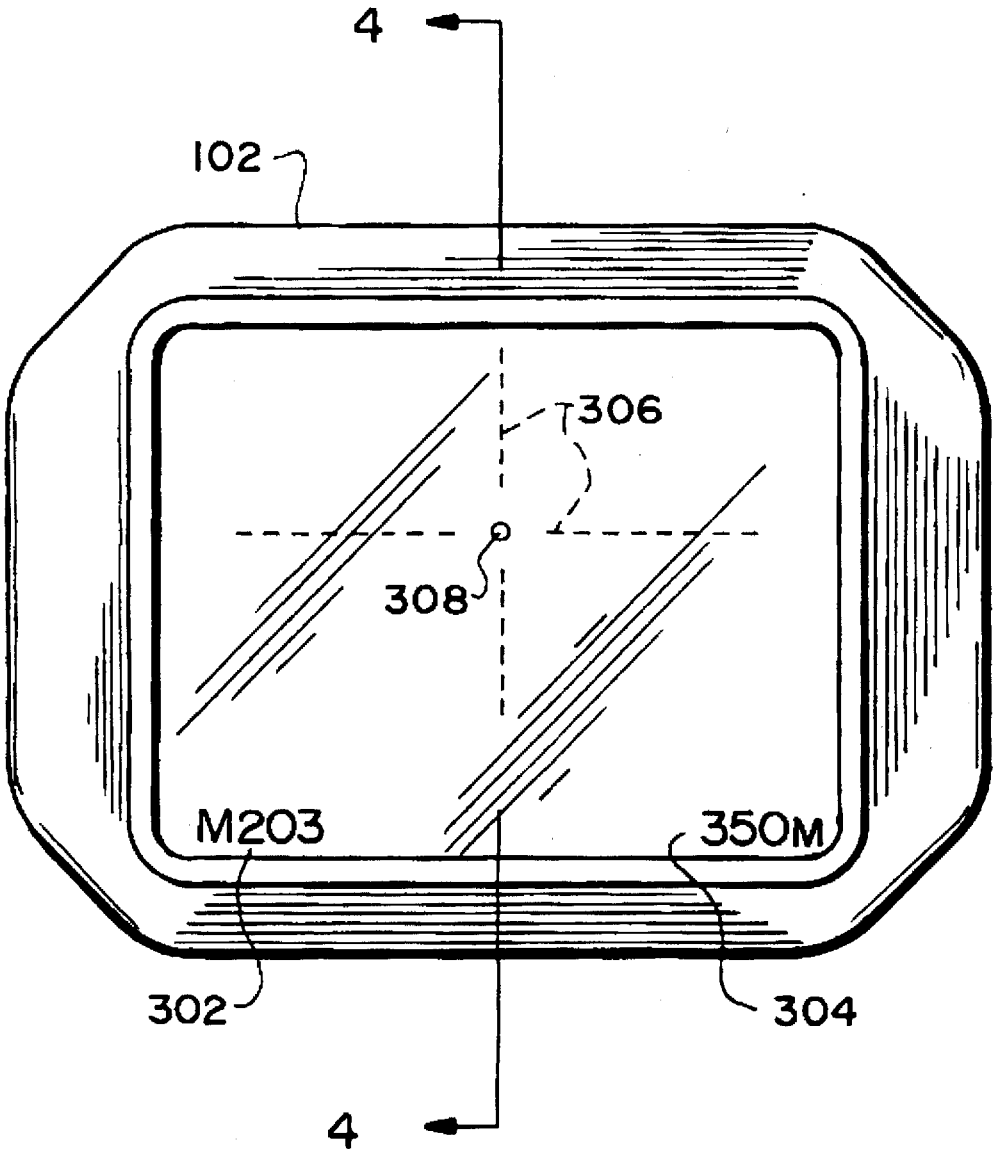
FIG. 3 is a detailed view of the "heads up" display that a user will view through the eyepiece of the laser range finder.

FIG. 3 is a detail of the "heads up" display that a user will view through eyepiece 226. Indicia 302 identifies the selected weapon platform that finder 102 is installed on. In this example, the M203 grenade launcher that is part of the M-16 has been selected. Indicia 304 indicates that the distance to the target, that is the distance to place where laser pointer dot 308 is impacting, is 350 meters. Indicia 302 and 304 are displayed using L.E.D. or L.C.D.'s by techniques well known in the art. Laser pointer dot 308 is aligned with the cross hairs 306 of the telescopic sights within finder 102. Laser pointer dot 308 can be either a visible laser or an infrared laser depending on whether keypad 220 or keypad 222 is selected.

Figure 4:
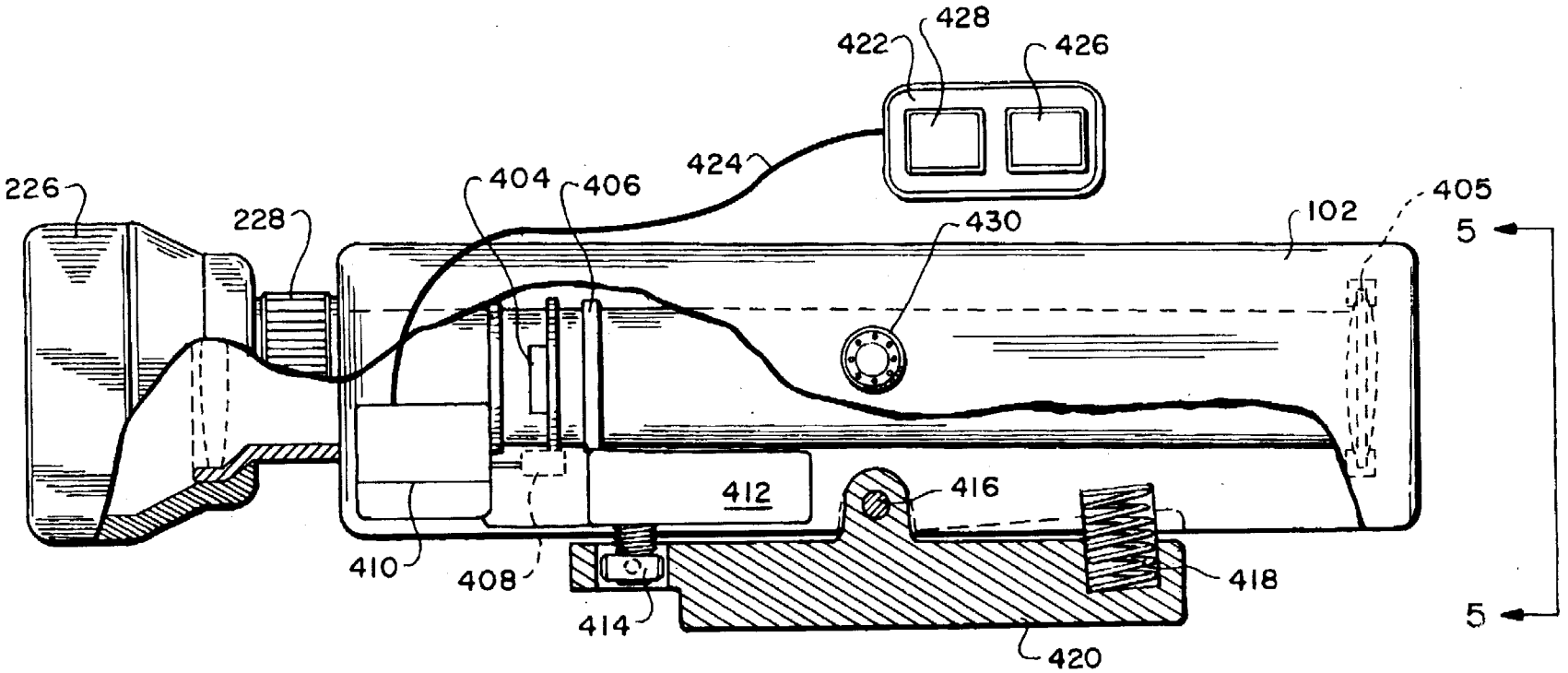
FIG. 4 is a side cross-sectional view of the laser range finder along section lines BB shown in FIG. 3.

FIG. 4 is a side, cross-sectional view of finder 102 along section lines BB shown in FIG. 3. The range finder utilized in finder 102 is preferably an optical time domain distance measuring device. However, other laser range finding systems could also be employed. A pulsed 1540 nm infrared laser 502 is reflected on the target. Laser 502 is directed to be in the exact same plane as laser pointer 308. The return signal from laser 502 is timed and is received through forward lens assembly 405. The-signal is filtered though a not pass optical filter 406, well known in the field, to eliminate ambient light interference. The signal is detected utilizing a "PIN" photoelectric diode 404, also well known in the field, wherein the signal is converted into electrical pulses that are received and timed by a time/counter crystal 408. Each pulse at approximately 33 MHz is equivalent to 5 meters of distance. The distance equivalent is then communicated to microprocessor 410 which drives servo motor 412. Motor 412 drives ball screw assembly 414 causing finder 102 to rotate about the trajectory pivot pin 416, thereby, achieving the desired trajectory compensation. Constant resistance is maintained via tension spring 418 located between finder 102 and interface subplate 420 which serves to mount finder 102 to the weapon.

If finder 102 is mounted on a weapon other than an M-16 type of weapon, an additional activation pad 422 is required. Pad 422 is connected to microprocessor 410 via a flexible cable 424. The "RANGE" keypad 426 actives finder 102 when depressed, stopping automatically when released. The "ON" keypad 428 activates the pre-determined laser pointer 504, 506 (shown in FIG. 5) for sighting after the determination of the range is achieved.

Finally, external interface 430 is provided to facilitate external communication to other devices so that firing can be coordinated with other weapons when necessary.

Figure 5:
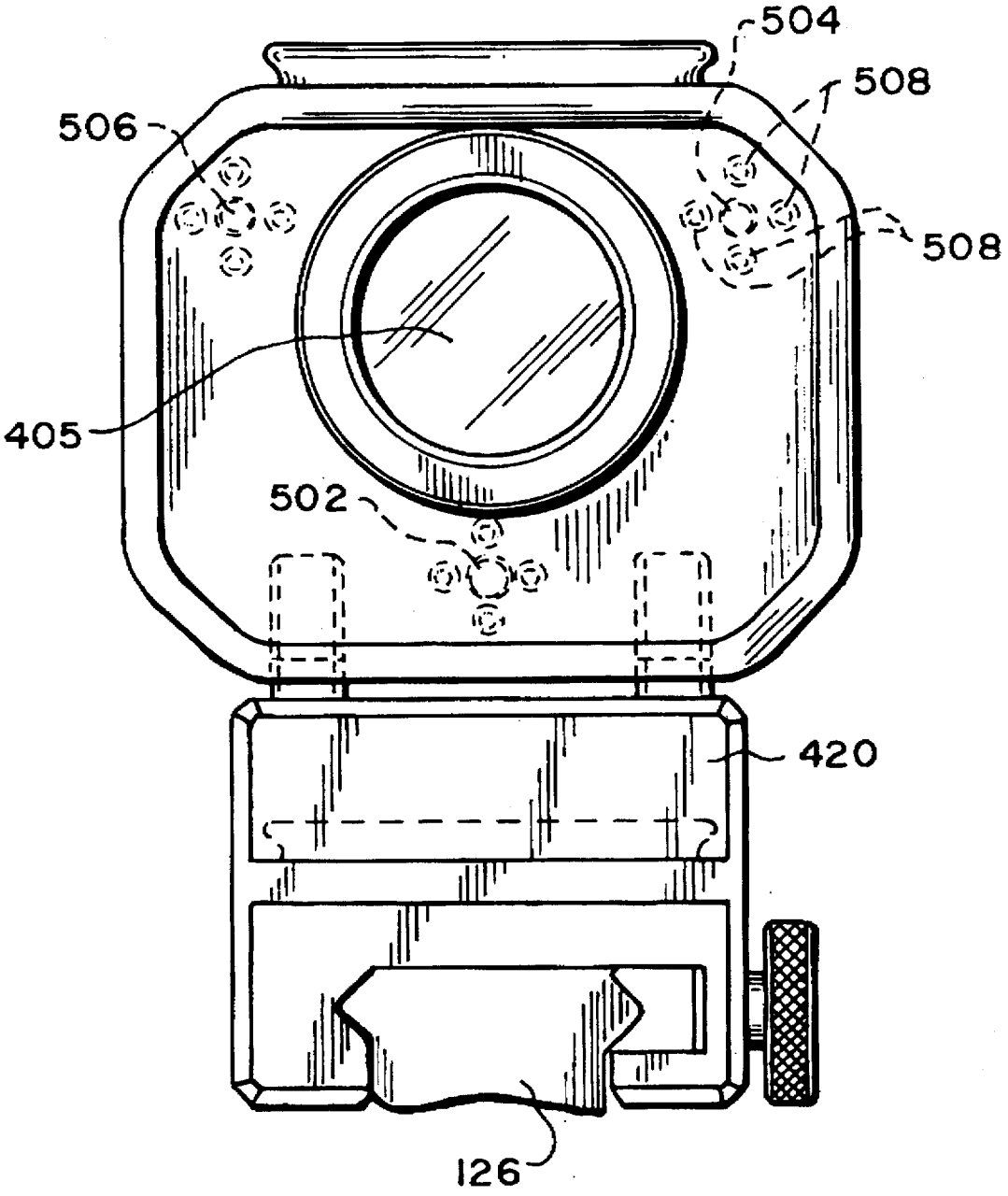
FIG. 5 is a front view of the laser range finder.

FIG. 5 is a front view of finder 102. Pulsing infrared ranging laser 502 is the only frequency detected by filtered "PIN" photoelectric diode 404 when the reflection from the target is received via the forward lens assembly 405. That is, reflections from visible laser 504, if keypad 222 has been selected, or from infrared laser 506, if keypad 220 has been selected, will not be detected. Visible 635 nm laser pointer 504 and 830 nm infrared laser 506 are sighted along the exact same plane as the pulsed infrared ranging laser 502, thus facilitating precision ranging and targeting. All lasers 402, 504, 506 are bore sighted using four cone point set screws 508 that contact the laser housing (now shown) allowing windage and elevation adjustment.

Figure 6:
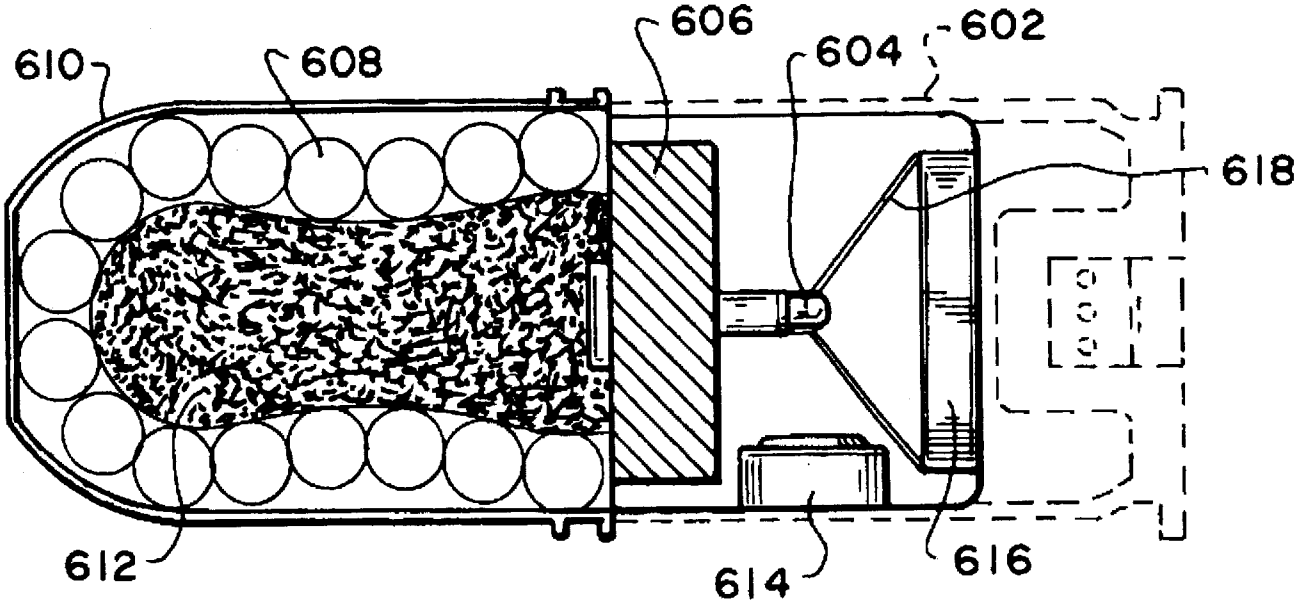
FIG. 6 is a side cross-sectional view of the laser detonated projectile.

FIG. 6 is a cross-sectional side view of the laser detonated projectile 602. This type of ordnance is similar to a standard "203" grenade that is designed to be fired with the M-16. A plurality of metal ball bearings 608 become individual projectiles upon detonation. High explosive compound 612 is surrounded by bearings 608. Metal cover 610 covers projectile 602. Cover 610 becomes shrapnel upon detonation. Explosive primer 606 is used to detonate explosive compound 612.

Projectile 602 is shot from a cartridge (shown in dotted lines) in the same manner as standard "203" ordnance. As noted above, wide angle infrared laser 116 transmits a detonation signal at the point when projectile 602 has reached the desired distance from the point of firing. This distance corresponds to the distance that the range finder had previously determined as being where the target was located. In this manner, projectile 602 can be detonated precisely at the target. It is also possible to detonate projectile 602 above the target so that it would be was located in foxholes where an enemy was located in foxholes or behind protective barriers.

In operation, the signal from laser 116 is transmitted through translucent plate 616. Preferably, plate 616 will be LEXAN. However, other materials could also be used providing that the material permits the infrared light from laser 116 to be passed through. Once inside, the signal is focused by reflector 618 which is preferably a parabolic shaped reflective surface that has a focal point corresponding to the location of infrared detector 604. Infrared detector 604 is powered by battery pack 614. Once I.R. detector 604 receives the detonation signal, primer 606 is electrically detonated. In this manner, the detonation of projectile 602 can be controlled throughout the useful operating range of the munition.

Figure 7:
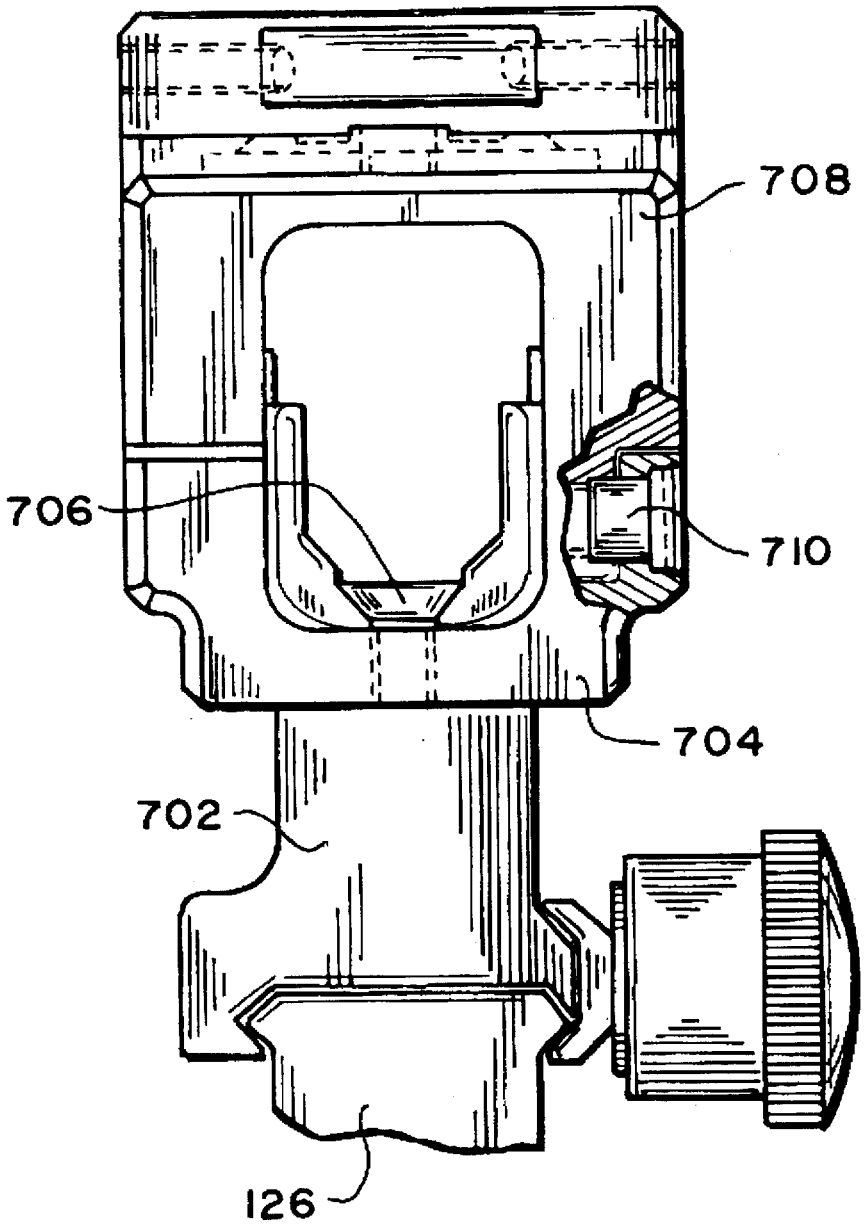
FIG. 7 is front cross-sectional view of the mounting bracket used to mount the laser range finder to a standard military issue weapon.

FIG. 7 is front cross-sectional view of the mounting bracket used to mount the laser range finder to a standard military issue weapon. This bracket permits mounting finder 102 or laser sight 124 on existing carry handle 702 which is found on the M41A. Lower mount 704 is attached to carry handle 702 via two flat head screws 706. Upper mount 708 is attached to lower mount 704 utilizing two (one on each side) shoulder bolts 710. Shoulder bolts 710 also act as the pivot point for range finder elevation adjustments.

Figure 8:
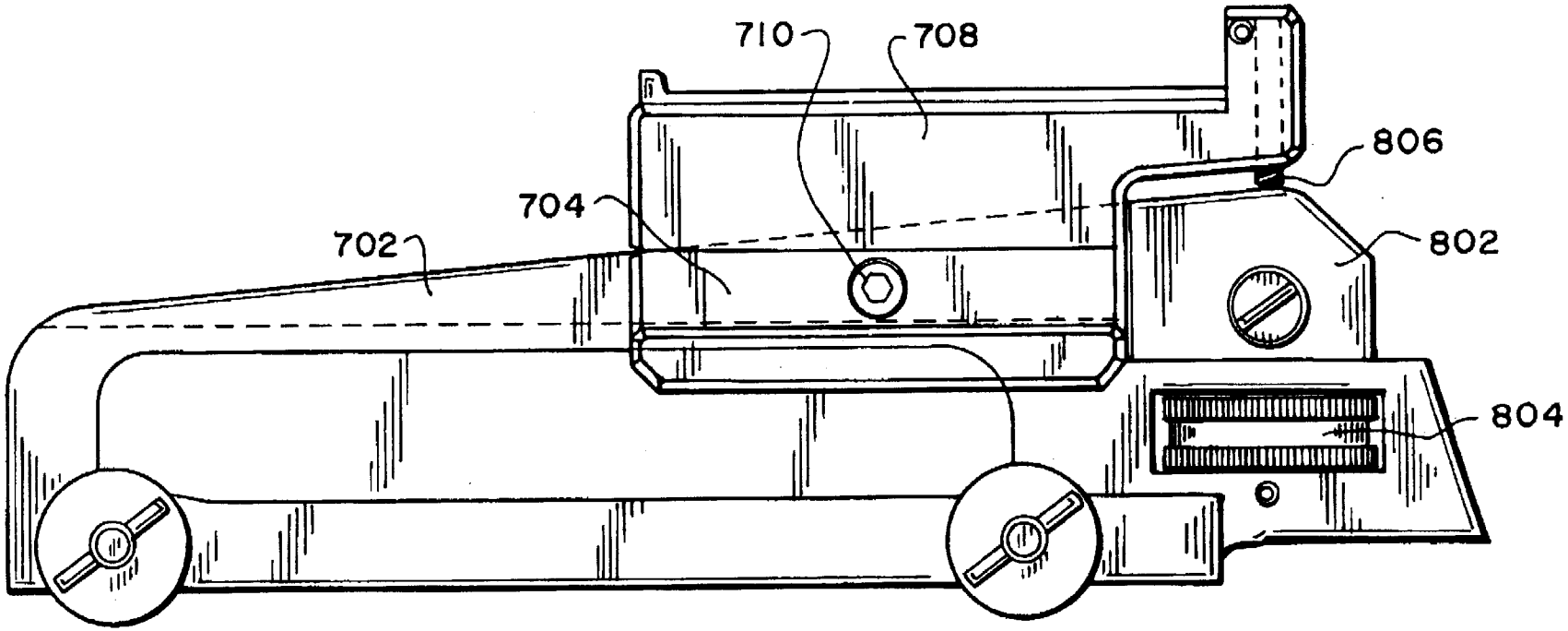
FIG. 8 is side view of the mounting bracket used to mount the laser range finder.

FIG. 8 is side view of the mounting bracket used to mount the laser range finder. Upper mount 708 and lower mount 704 are mounted to carry handle 702 so that the existing sighting block 802 and elevation adjusting wheel 804 can be utilized to adjust the laser sight module 124 for distance sighting via two set screws 806 contacting sighting block 802.

Figure 9:
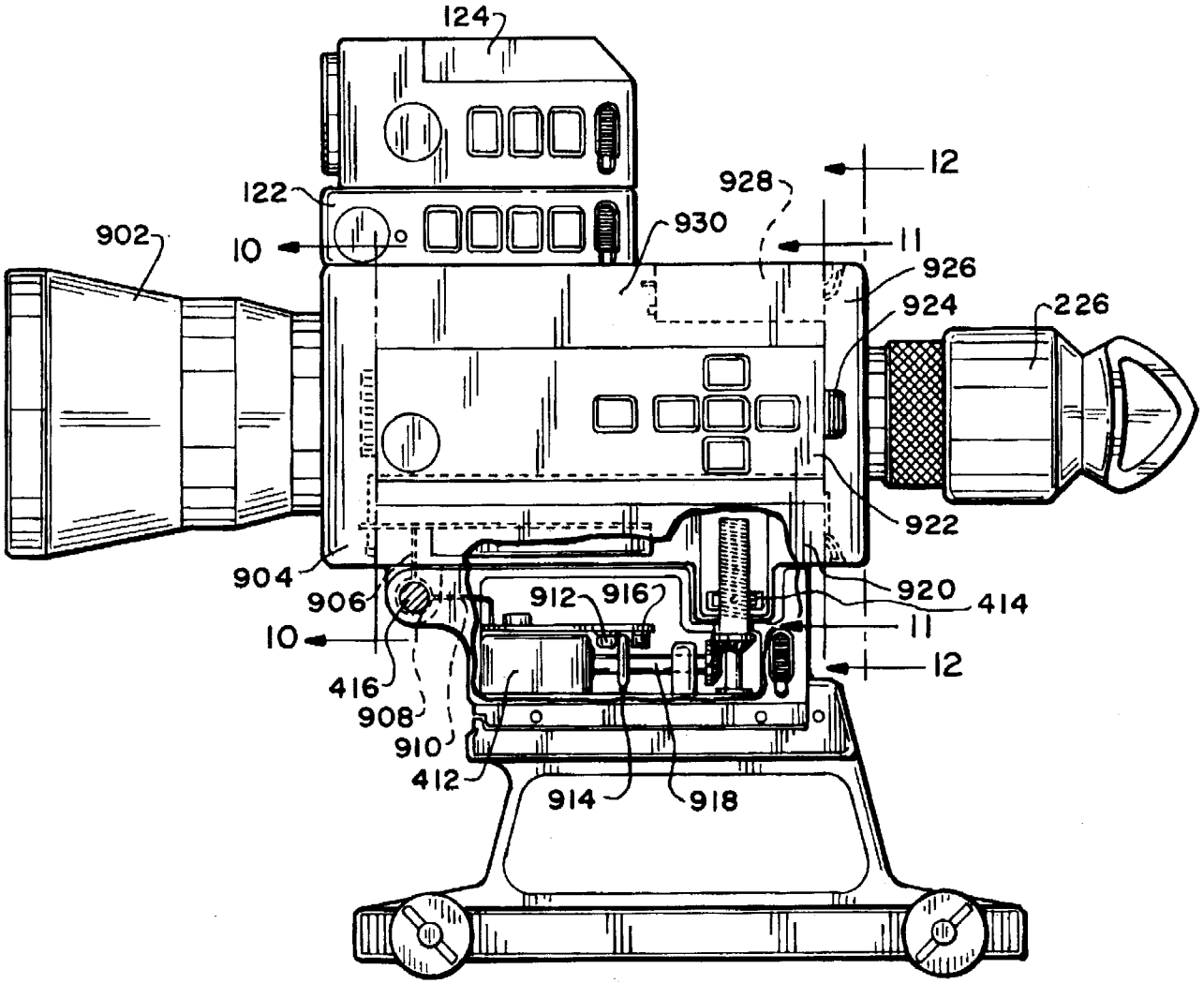
FIG. 9 is a side view of the preferred embodiment of the modular laser range finding apparatus mounted on a typical rifle.

FIG. 9 is a side view of the preferred embodiment of the modular laser range finding apparatus mounted on a typical rifle. This embodiment is similar to the one discussed above, except that it is more modular so that components can be replaced in the field. Further, this embodiment provides more sophisticated control and information to enable the user to operate more effectively. Main housing 930, wire harness assembly 904 and rear housing cap 926 hold each separate module in place on the apparatus. Molded clasp 924 enables a user to remove the module.

Motor module 920 contains many of the components described with the following exceptions. Serve motor shaft 918 has wheel 914 mounted so as to rotate when serve motor 412' operates. Wheel 914 contains a hole pattern that permits infrared light emanating from IR emitter 912 to pass through at time intervals to be received by IR detector 916. This signal is processed via microprocessor 410 and controls elevation.

Power is routed through wire harness assembly 904 to motor drive module 920 via two flexible ribbon connectors 906 and 910 and hinge connector 908.

Lens 902 can now be changed to different magnifications such as 4×, 6×, and 10×. Lens 902 is attached via the same mechanism used for single lens reflex cameras.

Position on top of the apparatus is flashlight module 124 which is attached to laser sight module 122. Environmental module 928 serves to provide temperature, barometric pressure, humidity, etc. Module 928 could also serve to provide warnings of chemical or biological weapons as well as other hazards that might be expected to be encountered.

Figure 10:
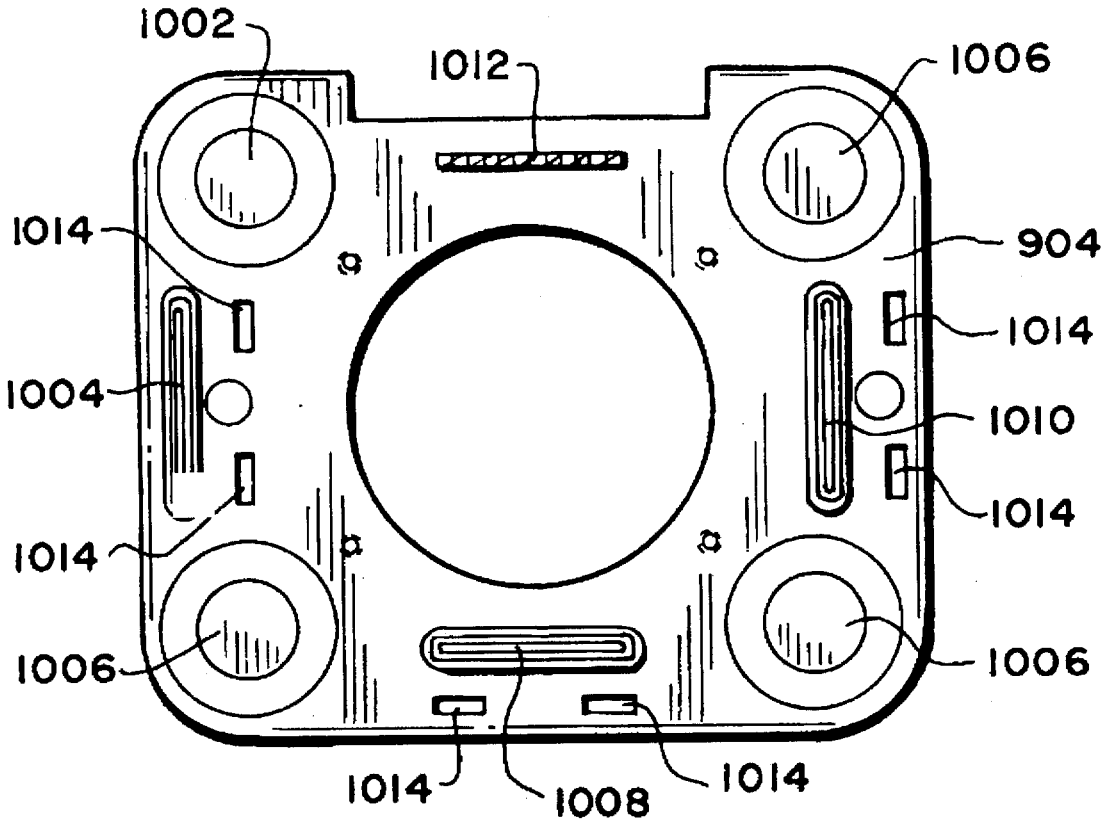
FIG. 10 is a cross-sectional detailed view of the preferred embodiment across section line DD as shown in FIG. 9.

FIG. 10 is a cross-sectional detailed view of the preferred embodiment across section line DD as shown in FIG. 9. This shows the detail of wire harness assembly 904 as to how it routes power from batteries 1102 (shown in FIG. 11) to the various electronic functions and from batteries 1104 (shown in FIG. 11) to motor drive module 920. Use of separate power sources eliminates electronic spiking and improves the reliability of apparatus.

Pick up 1102 is the power pick-up for all electronics. Female connector port 1004 is used for fire control module 922. Pick up 1006 is used for motor drive 412'. Female connector port 1008 is for motor drive module 920. Female connector port 1010 is used range finder module 1106. Ribbon connector 1012 is used for environmental module 922. Locating slots 1014 are used for positioning the connectors.

Figure 11:
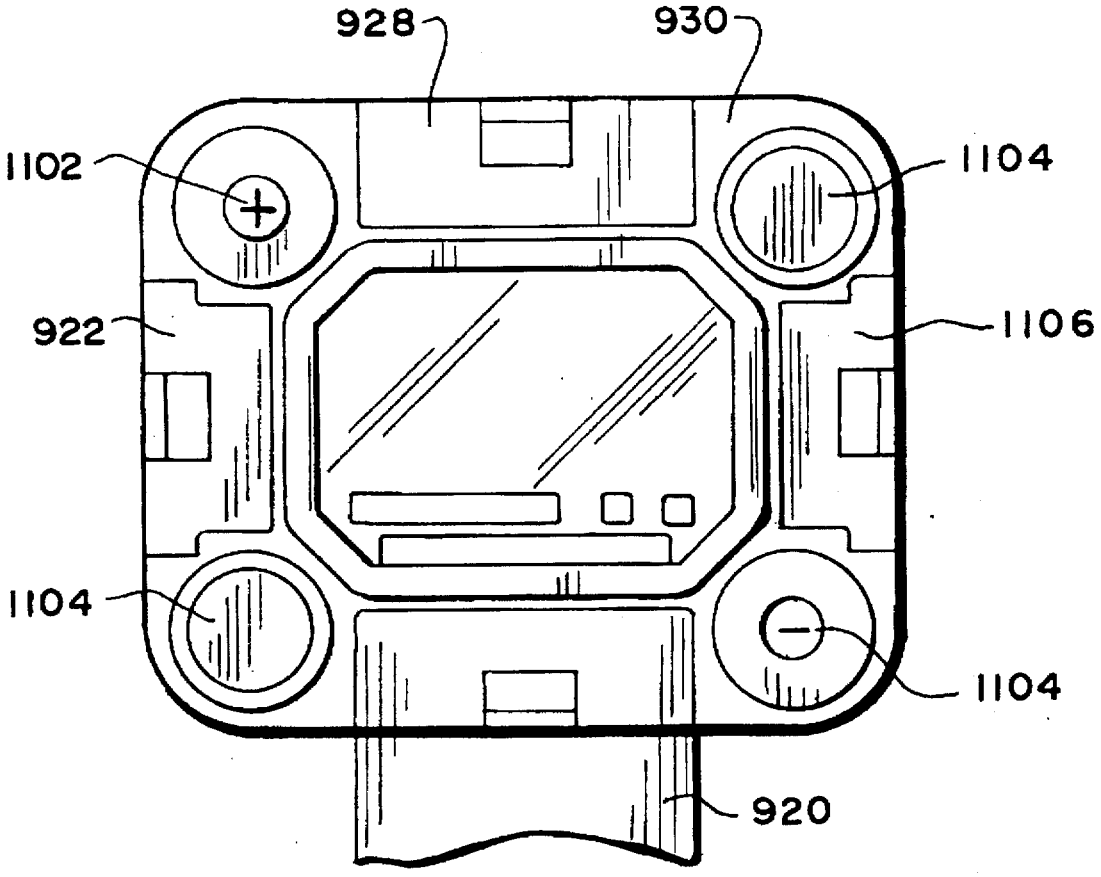
FIG. 11 is a cross-sectional detailed view of the preferred embodiment across section line EE as shown in FIG. 9.

FIG. 11 is a cross-sectional detailed view of the preferred embodiment across section line EE as shown in FIG. 9. As noted above, batteries 1102 and 1104 are used to power the apparatus. Batteries 1102 and 1104 are preferably three 3 volt lithium batteries. In this view, the modular aspect of the apparatus is clear. Main housing 930 holds motor module 920, fire control module 922, environmental module 928 and range finder module 1106.

Figure 12:
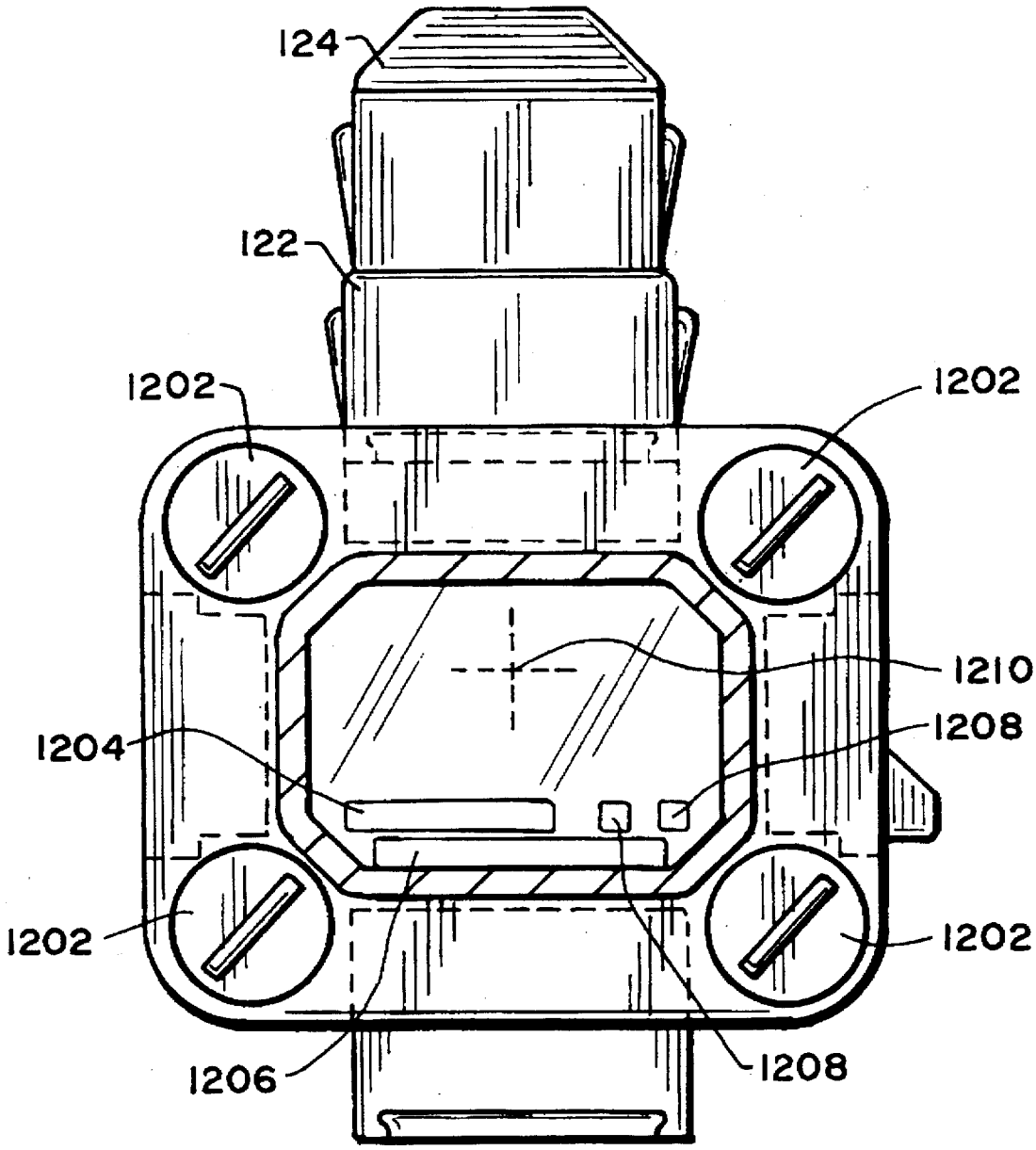
FIG. 12 is a cross-sectional detailed view of the preferred embodiment across section line FF as shown in FIG. 9.

FIG. 12 shows a detailed view of main menu 1204 of dot matrix display. The main menu features compass, diagnostic, power, fire control, environment, laser calibrate, owners manual (a "help" capability), and Language. Sub menu and text 1206 contains sub-menus and/or test information for each main menu function. For example, if main menu "FIRE CONTROL" is selected, the sub menu would be "M203" "SMART DART", "SMAW-D" or "LAM". Warning indicators 1208 indicates when power is low and when the apparatus is in the "fire" mode. Dot 1210 allows "re-zero" via software any time that weapon platforms are changed.

Figure 13:
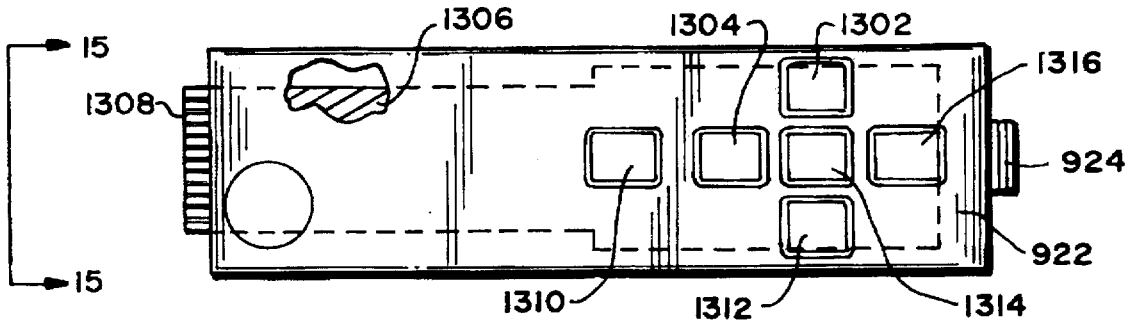
FIG. 13 is a left side view of the preferred embodiment across section line GG as shown in FIG. 11.

FIG. 13 shows the fire control keypads. The keypads control the electronic functions via the central processing unit and are displayed to the user via the dot matrix "heads-up" display discussed above. Cursor is controlled by scrolling up 1302, scrolling down 1312, scrolling left 1304 and scrolling right 1316. The unit is turned on or off via keypad 1310. Inside the fire control module is circuit board 1306 which is connected via edge connector 1308. This module is held in place via clasp 924 when clasp 924 is snapped into the rear housing cap 926.

Figure 14:
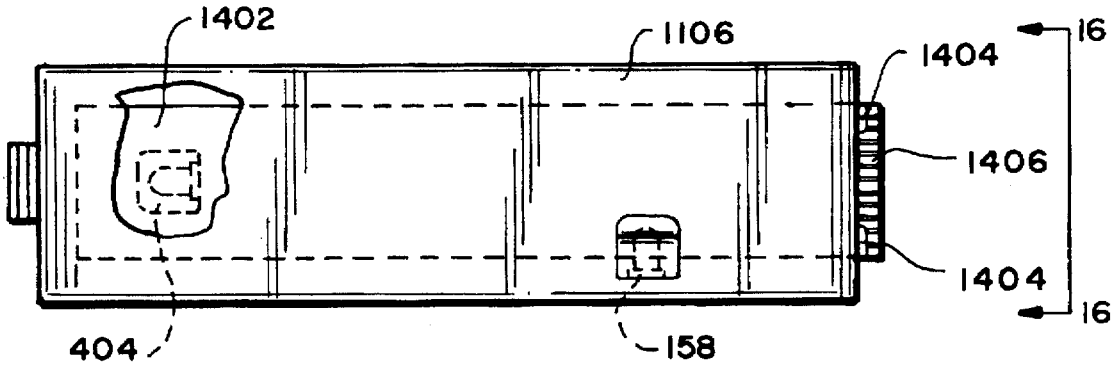
FIG. 14 is a right side view of the preferred embodiment across section line HH as shown in FIG. 11.

As shown in FIG. 14, locating tabs 1404 position the module 1106 into slots 1014 of the wire harness assembly 904, thereby securing edge connector 1406 into female connector port 1010. IR detector 158' communicates with grip circuits discussed above and in the prior applications via IR emitter 134 (shown in FIG. 1).

Figure 16:
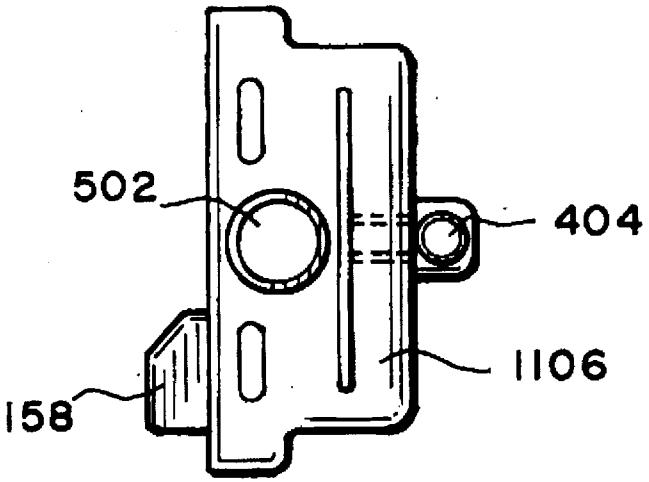
FIG. 16 is a detailed view across section line KK as shown in FIG. 14.
Figure 15:
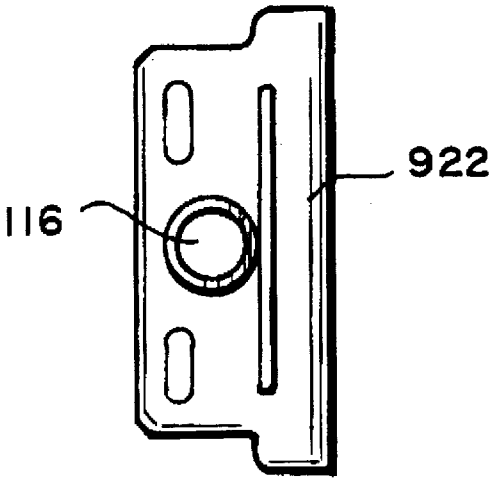
FIG. 15 is a detailed view across section line JJ as shown in FIG. 13.

As shown in FIG. 15, the laser detonated projectile shown in FIG. 6 is detonated via IR emitter 116'. The detonation timer of the laser detonated projectile is programmed upon leaving the launching tube of the grenade launcher. FIG. 16 shows the range finder IR detector 404' and infrared (1750 nm) range finder laser 502'.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A range finding apparatus for determining the range to a selected target comprising:

pulsed laser ranging means for sending a timed laser signal to the target with said signal being reflected from the target;

laser pointing means for selectively pointing a laser spot at the target with said laser pointing means and said pulsed laser ranging means being in the same plane;

selection means for filtering out the reflections emanating from the target as a result of the laser spot emitted by said laser pointing means and providing an output signal corresponding solely to the reflections received from said pulsed laser ranging means;

processing means for processing the output signal received from said selection means to provide a distance output signal that corresponds to the measured time of said timed pulsed laser signal to reach the target and return to said apparatus, said distance output signal corresponding to the range of the selected target; and elevation means for using the distance output signal of said processing means for automatically adjusting the elevation of said apparatus relative to a weapon that said apparatus is mounted upon, such that a projectile fired from the weapon will strike the target.

2. The range finder apparatus of claim 1 further comprising;

storage means, associated with said processing means, for storing trajectory information on a plurality of weapons and projectile combinations;

keypad means, connected to said processing means, for selecting a particular weapon and projectile combination so that trajectory of the selected weapon and projectile can be used to adjust said elevation means to enable the projectile to strike the target.

3. The range finder apparatus of claim 2 wherein said laser pointing means further comprises a visible laser and an infrared laser.

4. The range finder apparatus of claim 3 further comprising display means for displaying the distance to a target that the laser spot from said laser pointing means falls upon.

5. The range finder apparatus of claim 3 wherein said keypad means further comprises a plurality of rubberized buttons that can select a plurality of weapon and projectile combinations, a visible laser as said laser pointing means, an infrared laser as said laser pointing means, range displayed in yards, range displayed in meters, display intensity adjustment up, display intensity adjustment down, and manual elevation up and elevation down adjustments.

* * * * *